US007786662B2

(12) United States Patent
DiCarlo

(10) Patent No.: US 7,786,662 B2
(45) Date of Patent: Aug. 31, 2010

(54) DISPLAY USING A MOVABLE ELECTRON FIELD EMITTER AND METHOD OF MANUFACTURE THEREOF

(75) Inventor: Anthony DiCarlo, Richardson, TX (US)

(73) Assignee: Texas Instruments Incorporated, Dallas, TX (US)

( * ) Notice: Subject to any disclaimer, the term of this patent is extended or adjusted under 35 U.S.C. 154(b) by 841 days.

(21) Appl. No.: 11/134,163

(22) Filed: May 19, 2005

(65) Prior Publication Data

US 2006/0261724 A1 Nov. 23, 2006

(51) Int. Cl.
*H01J 1/30* (2006.01)

(52) U.S. Cl. ..... 313/495; 313/309; 313/351

(58) Field of Classification Search ..... 313/309–311, 313/336, 351, 422, 495–497; 315/169.1, 315/169.3; 438/20; 257/10
See application file for complete search history.

(56) References Cited

U.S. PATENT DOCUMENTS

| | | | | |
|---|---|---|---|---|
| 5,412,285 | A * | 5/1995 | Komatsu | 315/169.1 |
| 5,583,688 | A | 12/1996 | Hornbeck | |
| 5,652,474 | A * | 7/1997 | Wilshaw et al. | 313/336 |
| 5,666,025 | A | 9/1997 | Geis et al. | |
| 5,780,960 | A * | 7/1998 | Vickers | 313/310 |
| 6,084,255 | A | 7/2000 | Ueda et al. | |
| 6,856,446 | B2 | 2/2005 | DiCarlo | |
| 6,870,660 | B2 | 3/2005 | DiCarlo | |
| 7,126,266 | B2 * | 10/2006 | Park et al. | 313/495 |
| 7,180,233 | B2 * | 2/2007 | Ito et al. | 313/495 |
| 2002/0175609 | A1 * | 11/2002 | Shiffler, Jr. | 313/311 |
| 2003/0049899 | A1 * | 3/2003 | Syms | 438/200 |
| 2003/0117686 | A1 * | 6/2003 | DiCarlo | 359/291 |
| 2004/0007988 | A1 * | 1/2004 | Barger et al. | 315/169.3 |
| 2004/0066133 | A1 * | 4/2004 | Takeuchi | 313/495 |
| 2004/0108550 | A1 * | 6/2004 | Jin | 257/342 |
| 2007/0057283 | A1 * | 3/2007 | Shiozaki et al. | 257/144 |

FOREIGN PATENT DOCUMENTS

| | | | |
|---|---|---|---|
| JP | 55072347 | * | 5/1980 |
| WO | 0010190 | A2 | 2/2000 |
| WO | 03065425 | A2 | 8/2003 |

* cited by examiner

*Primary Examiner*—Joseph L Williams
*Assistant Examiner*—Fatima N Farokhrooz
(74) *Attorney, Agent, or Firm*—Warren L. Franz; Wade J. Brady, III; Frederick J. Telecky, Jr.

(57) ABSTRACT

A field emission device 100 comprises an anode 105 and a cathode 110 separated by a distance 115 from the anode. At least one of the anode or cathode is configured to move with respect to the other in response to an applied voltage 120 to at least one of the anode and cathode, the distance being adjustable by the movement.

19 Claims, 7 Drawing Sheets

DISPLAY USING A MOVABLE ELECTRON FIELD EMITTER AND METHOD OF MANUFACTURE THEREOF

TECHNICAL FIELD OF THE INVENTION

The present invention is directed to display technology and in particular, to an electron field emitter display and a method of manufacturing the display.

BACKGROUND OF THE INVENTION

An electron field emitter is a key component in phosphor display technology. Current phosphorous field emission displays require the electron field emitter to be enclosed in a high vacuum and ultra-clean environment. Such an environment is necessary to avoid the rapid deterioration of the types of cathodes currently being used in phosphor displays. Typically these cathodes have a pointed or conical shaped tip.

When a potential is applied between the anode and cathode, cathodes having a pointed or conical tip advantageously concentrate the electrical field strength around the tip. Consequently, relatively small potentials (e.g., less than about 10 Volts) between the cathode and anode of the display are needed to cause the emission of electrons. The ability to use such low potentials has an important benefit because conventional CMOS devices can operate at these low potentials, and therefore can be used to control the emission of electrons.

The use of pointed or conically shaped cathode tips has a major drawback however. The performance of the cathode deteriorates as material deposits on the tip and thereby changes the shape of the tip. Material from the anode can deposit on the cathode tip due to sputtering caused by electrons emitted from the cathode and hitting the anode. Additionally, contaminants remaining or leaking inside the chamber that encloses the cathode can deposit on the cathode tip.

A change in the shape of the cathode tip can change the density of the field around the tip, thereby changing the location from which electrons are emitted. This, in turn, defocuses the phosphor display. Eventually the performance of the cathode deteriorates to the point where the phosphorous display no longer operates within acceptable limits. Decreasing the rate of deterioration by enclosing the electron field emitter in an even cleaner environment or higher vacuum is a major cost in the fabrication of phosphorous displays, and it is becoming prohibitively expensive to improve upon existing vacuum technologies to improve cathode lifetime.

Accordingly, what is needed in the art is an electron field emitter device that can operate in environments that are easy to achieve and has a long lifetime, while not experiencing the above-mentioned problems.

SUMMARY OF THE INVENTION

To address the above-discussed deficiencies of the prior art, the present invention provides, in one aspect, provides a field emission device. The field emission device comprises an anode and cathode. The anode and cathode are separated by a distance, and at least one of the anode or the cathode is configured to move with respect to the other. Movement is in response to a voltage applied to at least one of the anode and the cathode, the distance being adjustable by the movement.

In another aspect, the present invention provides a method of manufacturing a field emission device. The method comprises forming a control circuit in a semiconductor substrate and forming an anode over the semiconductor substrate. The method also comprises forming a cathode over the semiconductor substrate, wherein the cathode is separated by a distance from the anode. The distance is adjustable by moving at least one of the anode and cathode with respect to the other by applying a voltage to at least one of the anode and cathode.

In still another aspect, the present invention provides a display system. The display system comprises the above-described field emission device and a phosphor surface. A current of electrons passing from the cathode to the anode is configured to pass through the anode to cause the phosphor surface to emit light.

The foregoing has outlined preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed concepts and specific embodiments as a basis for designing or modifying other structures for carrying out the same purposes of the present invention. Those skilled in the art should also realize that such equivalent constructions do not depart from the scope of the invention.

BRIEF DESCRIPTION OF THE DRAWINGS

For a more complete understanding of the present invention, reference is made to the following detailed description of example embodiments, taken in conjunction with the accompanying drawings, in which.

DETAILED DESCRIPTION

The present invention recognizes that the performance of a field electron emitter can be substantially improved by controlling the emission of electrons through dynamic adjustments in the distance between the cathode and anode during the emitter's operation. Electron emission can be controlled in this fashion because the strength of the electric field between the anode and cathode is inversely proportional to the distance between the anode and cathode. As further illustrated in the described embodiments of the invention, controlling electron emissions by having an adjustable distance between the anode and cathode facilitates the incorporation of a number of advantageous cathode designs into field electron emitter devices and displays having such devices.

Figure 1:
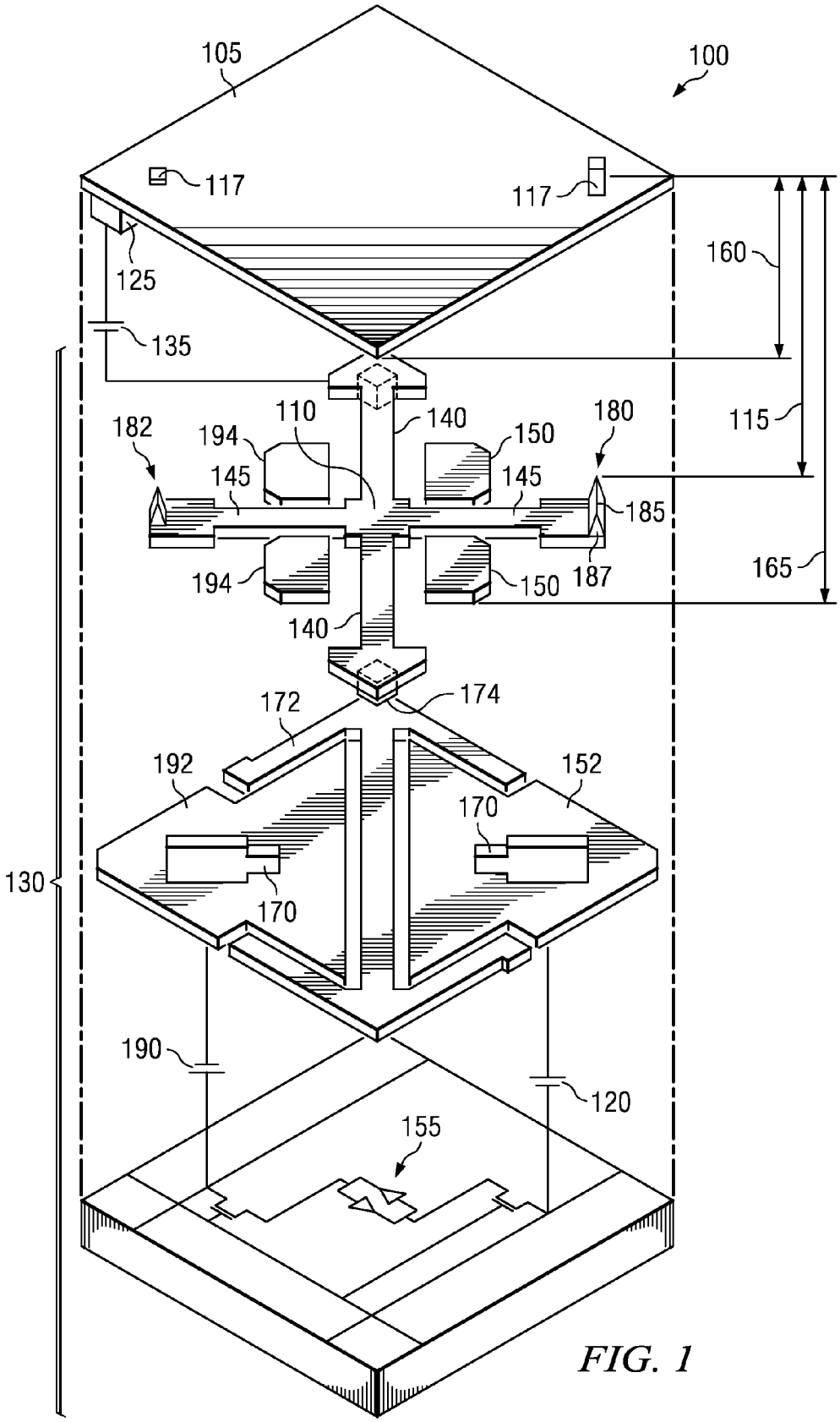
FIG. 1 illustrates an exploded perspective view of selected aspects of one embodiment of a field emission device of the present invention.

FIG. 1 illustrates an exploded perspective view of selected aspects of an example field emission device 100 of the present invention. The field emission device 100 comprises an anode 105 and a cathode 110. The cathode 110 is separated from the anode 105 by a distance 115. For the purposes of the present invention, the distance 115 refers to the distance separating an aperture 117 of the anode 105 and a portion of the cathode 110 that emits electrons through the aperture 117. At least one of the anode 105 or the cathode 110 is configured to move with respect to the other, to thereby adjust the distance 115. The movement of the anode 105, cathode 110 or both, is in response to a voltage 120 applied to at least one of the anode 105 or cathode 110.

In some embodiments of the field emission device 100, the anode 105 is coupled to a first substrate 125, and the cathode 125 is coupled to a second substrate 130. The distance 115 is adjusted by at least one of the first and second substrates 125, 130 being movable with respect to the other by application of the applied voltage 120. For the embodiment illustrated in FIG. 1, the first substrate 125 is configured to hold the anode 105 in a fixed location, while the second substrate 130 is configured to move the cathode 110. Of course in other embodiments of the field emission device 100, the anode 105 is movable and the cathode 110 is fixed, or both the anode and cathode 105, 110 are movable.

In some embodiments, the field emission device 100 comprises a plurality of cathodes 110 such as depicted in FIG. 1, located in proximity to a single anode 105 having a plurality of apertures 117. In other embodiments, the field emission device 100 comprises a plurality of anodes 105 and cathodes 110 arranged in a two-dimensional array.

It is advantageous for at least one of the first or second substrates 125, 130 to comprise a microelectromechanical system (MEMS). In certain preferred embodiments, movement is accomplished by coupling the anode 105 or cathode 110 to a first or second substrate 125, 130 comprising a MEMS. Those of ordinary skill in the art are familiar with various MEMS configurations and how components of the MEMS can be configured to move the anode or cathode in response to an applied voltage. Non-limiting examples of suitable MEMS configurations include MEMS actuators whose motion is electrostatically or piezoelectrically driven. Examples of electrostatically driven MEMS are presented in U.S. Pat. Nos. 5,583,688 and 6,856,446, which are incorporated by reference herein.

For the particular embodiment depicted in FIG. 1, the first substrate 125 comprises a fixed support body for the anode 105 while the second substrate 130 comprises a MEMS. In some cases, as illustrated in FIG. 1, in addition to providing mechanical support, the first substrate 125 is also electrically coupled to the anode 105. Even more preferably, the first substrate 125 electrically couples the anode 105 to a voltage source 135, which is also electrically coupled to the cathode 110. Of course in other embodiments, the anode 105 and cathode 110 can each be directly coupled to the voltage source 135.

The second substrate 130 depicted in FIG. 1 comprises a MEMS having a hinge element 140 and a spring element 145. For the illustrated embodiment, both the hinge and spring elements 140, 145 are components of the cathode 110. The spring element 145 is rotated about the hinge element 140 to change the distance 115 separating the anode 105 and cathode 110, thereby making the cathode 110 a rotating cathode. The rotation of the spring element 145 is achieved by applying the voltage 120 to one or more electrode pad 150, 152 electrostatically coupled to the spring element 145. Preferably the voltage 120 is applied by a control circuit 155 electrically coupled to the electrode pad 150. It is desirable for the control circuit 155 to comprise a complementary metal oxide semiconductor (CMOS) device. Preferably the electrode pads 150, 152 can be addressed by the control circuit 155 comprising a CMOS static random access memory (SRAM) cell, such as a five-transistor or six-transistor SRAM cell.

As well known to those skilled in the art, when the voltage 120 is applied, electrostatic fields are developed between the cathode 110 and the electrode pads 150, 152 creating an electrostatic torque. The electrostatic torque works against the restoring torque of the hinge element 140 to rotate the cathode to a minimal span 160 or maximal span 165 separating the anode 105 and cathode 110. In some instances, one or more of the electrode pads 152 has an opening 170 to facilitate movement of the cathode 110 through the electrode pad 152 to land on the surface of the control circuit 155, thereby allowing the cathode 110 to move a greater distance 115 away from the anode 105.

Some preferred configurations of the second substrate 130 further comprise a bias bus 172 and cathode support post 174. The bias bus 172 interconnects a plurality of field emission devices 100 preferably arranged in a two-dimensional array, to a common driver that supplies the desired bias waveform for proper digital operation. The cathode support post 174 holds the hinge element 140 above the electrode pad 152 and bias bus 172, thereby allowing the hinge element 140 to twist in a torsional fashion. One skilled in the art would be familiar with other optional components that could be included in the second substrate 130 to facilitate the movement and support of the cathode 110.

The cathode 110 in FIG. 1 is depicted for illustrative purposes with first and second tips 180, 182 having two different shapes: knife-edged and conical, respectively. As part of the present invention, it is recognized that the operating lifetime of the device 100 is increased by configuring the cathode 110 to have a knife-edged tip 180. As used herein, the term knife-edged tip is defined as cathode having a straight edge 185 that is at least about 5 nanometers long and with a radius of curvature 187 between about 1 nanometer and 20 nanometers.

Under the appropriate conditions, a cathode 110 having a knife-edged tip 180 emits a current of electrons from the entire straight edge 185. Consequently, even if there is a point failure along the straight edge 185, electrons are still emitted from other locations along the edge. Therefore, the lifetime of the field electron emitter device 100 is increased as compared to a device having a cathode with a conical-shaped cathode tip 182. As discussed above, the performance of a cathode having a conical-shaped cathode tip 182 deteriorates when material deposits on or near the tip 182.

Although an arrangement of differently shaped first and second tips 180, 182 is within the scope of the present invention, it is more preferable for the cathode 110 to have two tips 180, 182 of the same shape: either both knife-edged or both conical. Of course, the cathode 110 can be configured to have a single tip or more than two tips, if desired.

As well understood by those skilled in the art, when a suitable potential is applied between the anode 105 and cathode 110 by the voltage source 135, electrons are emitted from the cathode 110 in accordance with the Fowler Nordheim equation. Unfortunately, a higher potential difference (e.g., at least about 10 Volts) is required to cause electrons to emit from a knife-edged tip 180 than a conical tip 182 for a given distance 115. Consequently, a control circuit 155 comprising a CMOS device, which typically operates at less than about 10 Volts, cannot be used to directly control the emission of electrons from the knife-edged cathode 180.

The present invention ameliorates this limitation by providing a field electron emitter device 100 whose anode 105 or cathode 110 is configured to move with respect to the other. As the distance 115 between the anode 105 and cathode 110 is reduced, the strength of the electrical field at the cathode 110 is increased for a given potential difference applied by the voltage source 135 to the anode 105 and cathode 110. The increased electric field strength promotes electron emission. Conversely, as the distance 115 is increased, the strength of the electric field at the cathode 110 is decreased for the given potential difference, and hence electron emission does not occur.

By decreasing the distance 115 to a minimal span 160, a device 100 having a cathode 110 with a knife-edge tip 180 can be configured to emit electrons in conjunction with a lower applied potential from the voltage source 135. Moreover, the emission of electrons can be stopped by increasing the distance 115 to a maximal span 165. The distance 115 is changed from the minimal span 160 to maximal span 165 by changing the control circuit 155 comprising a CMOS device between its complementary states. For instance, in some preferred embodiments, the complementary states of the CMOS device of the control circuit 155, corresponding to "on" and "off," are applied voltages 120 of 7.5 and 0 Volts, respectively, or 3.3 and 0 Volts, respectively. In some configurations, the distance 115 is adjusted to the minimal span 160 and to the maximal span 165 when the CMOS device is in the "on" state and "off" state, respectively.

In instances where the cathode 110 has two tips 180, 182 such as depicted in FIG. 1, moving the first tip 180 to its minimal span 160 will cause the second tip 182 to move to its maximal span 165. The movement of the second tip 182 is facilitated by applying a voltage 190 to electrode pads 192, 194, analogous to that described above for the first tip 180.

The emission of electrons from the device 100 is thereby indirectly controlled by the control circuit 155 comprising a CMOS device, through its application of a voltage 120 to move the cathode 110. Importantly, the applied voltage 120 needed to move the cathode tip 180 between its minimal span 160 and maximal span 165 is less than about 10 Volts. This advantageously allows the control circuit 155 to use conventional CMOS devices, operating at low voltages, to control electron emission.

One skilled in the art would understand how to adjust the potential applied by the voltage source 135 to produce an electrical field sufficient to cause the emission of electrons when the anode 105 and cathode 110 are separated by the minimal span 160, but to not emit electrons when they are separated by the maximal span 165. The choice of the potential to apply by the voltage source 135 will depend upon multiple parameters, such as the minimal and maximal distance spans 160, 165, the shape of the cathode tip 180, the applied voltage 120, and the materials used for the anode 105 and cathode 110.

As a non-limiting example, consider an embodiment of the device 100, where the anode 105 and cathode 110 are composed of aluminum or aluminum alloy. The minimal span 160 is from about 300 to 500 nanometers and the maximal span 165 is from about 2 to 10 times longer than the minimal span 160. The movement of the cathode 110 tip 180 between these distances is accomplished by varying the applied voltage 120 from an "on" state of 7.5 Volts to an "off" state of 0 Volts. Of course, one skilled in the art would understand how to use more complex voltage schemes to drive the movement of the cathode 110, and how to adjust these and other parameters to accommodate alternative configurations of the device 100.

In some cases a device 100 configured in this fashion would require the potential from the voltage source 135 to be in the range of about 1 Volt to about 10 Volts. In other cases, however, the required potential can be greater than about 10 volts. The device 100 of the present invention can easily apply potentials of greater than 10 Volts, because the voltage source 135 does not have to contain CMOS devices. Therefore, the voltage source 135 is advantageously not limited to CMOS operating voltages, which typically are maximally about 10 Volts.

FIGS. 2-9 illustrate steps in an example method of manufacturing a field emission device following the principles of the present invention. The method can be used to fabricate any of the embodiments of the field emission device presented in the context of FIG. 1 and discussed above.

Figure 2:
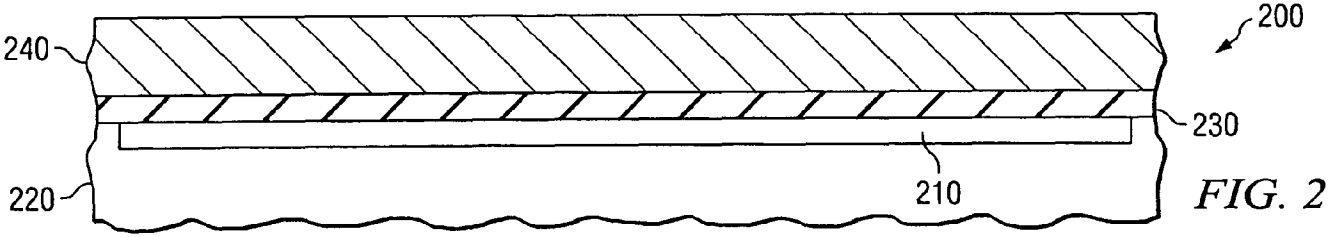
FIGS. 2-9 illustrate cross-sectional views, corresponding to sections taken along a longitudinal axis of spring element 145 of FIG. 1, of selected steps in an example method of manufacturing a field emission device following the principles of the present invention.

FIG. 2 illustrates a partially completed field emission device 200 after forming a control circuit 210 in a semiconductor substrate 220. Forming the control circuit 210 preferably comprises forming a plurality of CMOS devices, and, more preferably, forming addressable SRAM circuits. Also depicted in FIG. 2 is the partially completed device 200 after covering the control circuit 210 with an insulating layer 230 and forming a metal layer 240 over the insulating layer 230. The insulating layer 230 preferably comprises an oxide, such as silicon oxide, that has been planarized by chemical-mechanical planarization. The metal layer 240 preferably comprises aluminum or aluminum alloy that has been sputter deposited. Vias are formed in the insulating layer 230 to allow the metal layer 240 to contact the underlying control circuit 210 where necessary.

Figure 3:
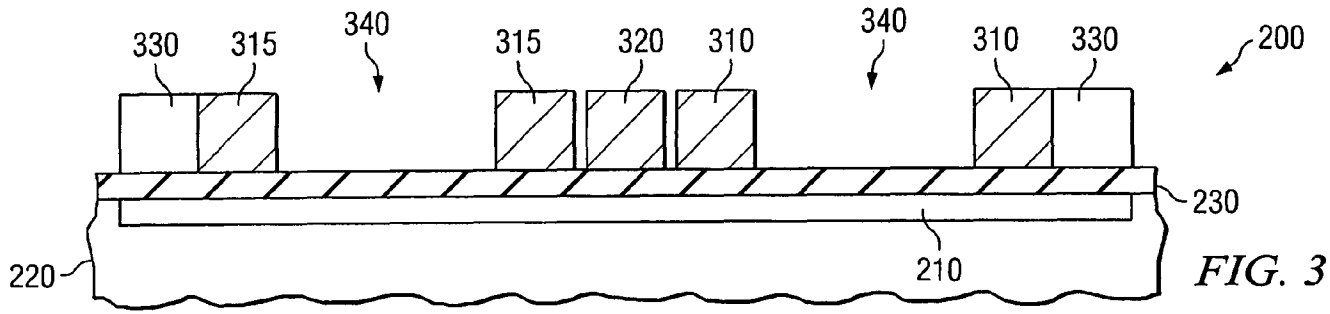

FIG. 3 shows the partially completed field emission device 200 after patterning the metal layer 240 to form electrode pads 310, 315, a bias bus 320 and first substrate 330. Preferably the metal layer 240 is patterned by plasma-etching using plasma-deposited $SiO_2$ as the etch mask. In some instances, voids or openings 340 are formed in the electrode pads 310, 315 to facilitate greater movement of the cathode. In preferred embodiments, patterning to form the first substrate 330 further comprises forming interconnections to a voltage source and cathode (not shown in the cross-sectional views of FIGS. 2-9).

Figure 4:
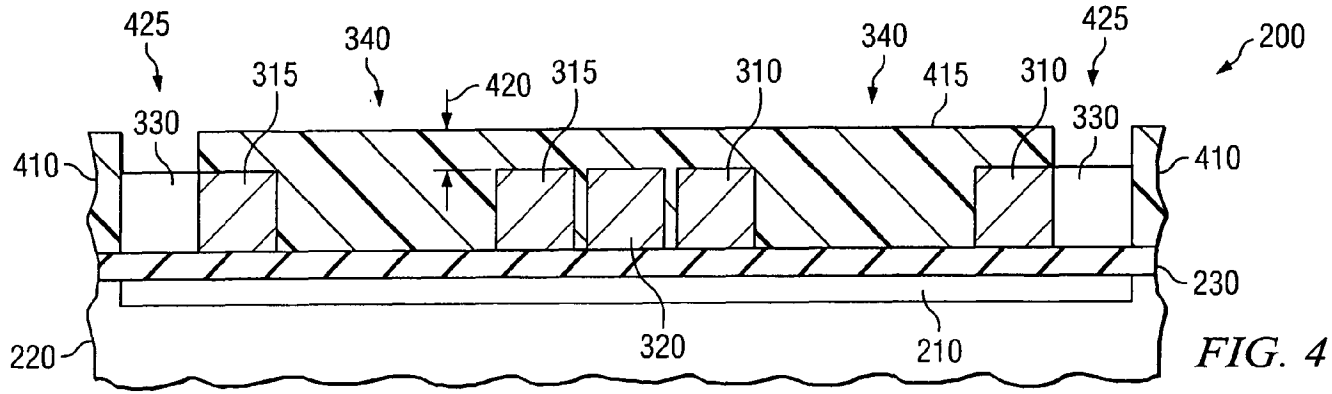

FIG. 4 presents the partially completed field emission device 200 after forming a first spacer layer 410 over the electrode pads 310, 315 and bias bus 320 and in the voids 340. Preferably, the first spacer layer 410 is formed by spin depositing a photoresist and then deep UV hardening the photoresist to a temperature of about 200° C. to prevent flow and bubbling during subsequent processing steps. The first spacer layer 410 is configured to provide a planar surface 415 on which to build the cathode and to provide a gap 420 between the cathode and electrode pads 310, 315 and bias bus 320. Conventional patterning and etching techniques are used to form openings 425 in the first spacer layer 410 to allow further construction of the first substrate 330 or the formation of support posts for the cathode (not shown in the cross-sectional views of FIGS. 2-9).

Figure 5:
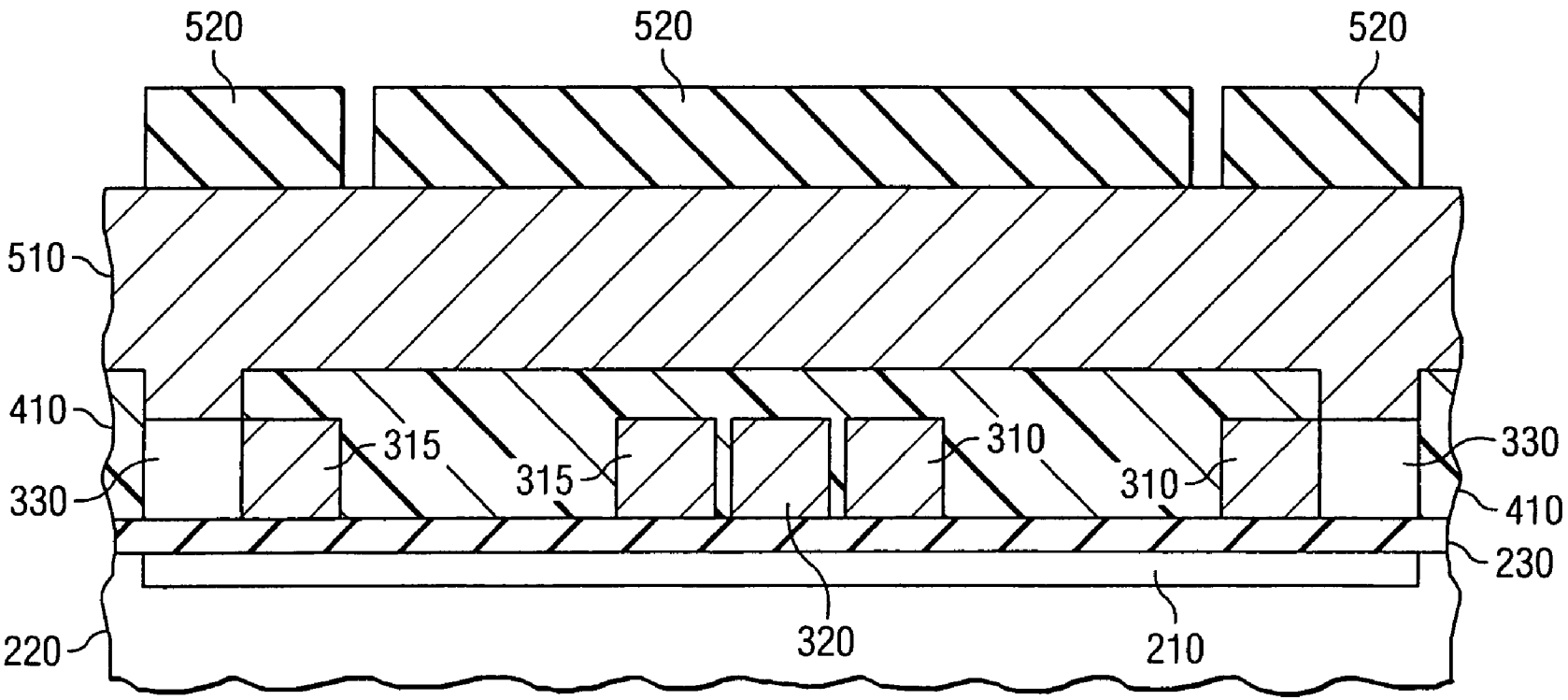

FIG. 5. illustrates the partially completed field emission device 200 after forming a second metal layer 510 over the first spacer layer 410. Preferably, the second metal layer 510 is formed using similar procedures and materials as described above for forming the first metal layer 240. Also shown in FIG. 5, an etch mask 520, such as a plasma-deposited $SiO_2$ etch mask, is formed over the second metal layer 510 to define a pattern for etching the second metal layer 510.

Figure 6:
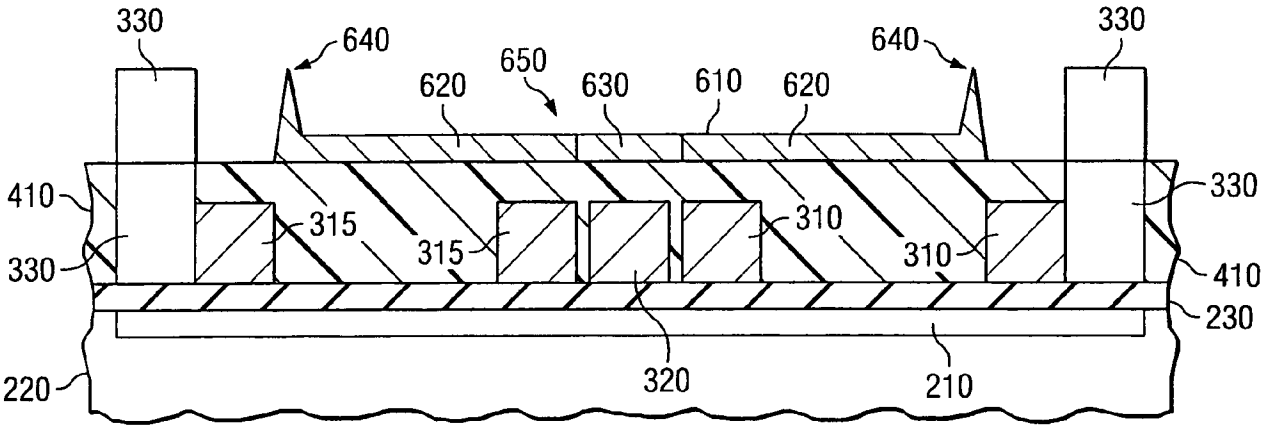

FIG. 6 shows the partially completed field emission device 200 after patterning the second metal layer 510 to form a cathode 610 over the semiconductor substrate 220. Patterning the second metal layer 510 preferably also comprises further forming the first substrate 330. Similar plasma-etching procedures used to pattern the first metal layer 240 can also be used to pattern the second metal layer 510. Patterning to form the cathode 610 comprises forming one or more spring elements 620 and hinge elements 630. In certain instances, it is desirable to perform additional patterning and isotropic etching steps to form one or more tips 640 of the cathode 610, such as conical or knife-edged tips. It is advantageous if the patterning process to form the cathode 610 also forms electrode pads located in the same lateral plane as the cathode 610 (not visible in the cross-sectional views presented in FIGS. 2-9) similar to the electrode pads 150, 194 depicted in FIG. 1. The patterning is performed to configure the spring element 620 to be electrostatically couplable to the in-plane electrode pads or underlying electrode pads 310, 315. The control circuit 210, electrode pads 310, 315, bias bus 320 and cathode 610 are referred to as a second substrate 650.

Figure 7:
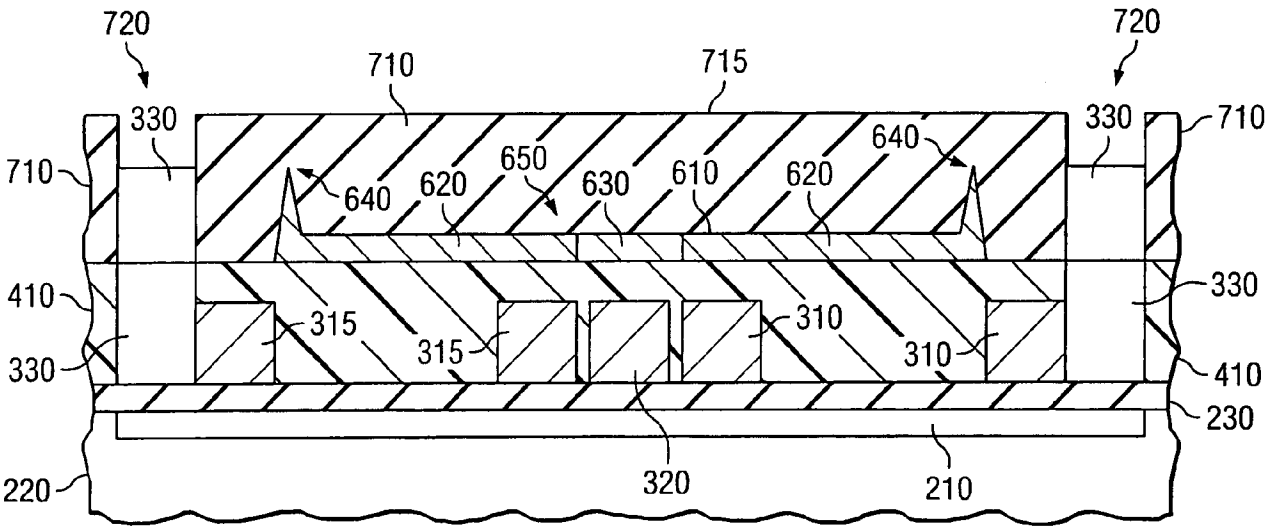

FIG. 7 shows the partially completed field emission device 200 after forming a second spacer layer 710 over the second substrate 650. Again, similar procedures and materials are used to form the second spacer layer 710 as described for forming the first spacer layer 410. The second spacer layer 710 provides a planar surface 715 on which to build the anode and serves to separate the anode and cathode 610 from each other. Analogous to openings 425 discussed above in connection with the patterning of the first spacer layer 410, the second spacer layer 710 is patterned to provide openings 720 to allow further construction of the first substrate 330 and to form other anode support structures if needed.

Figure 8:
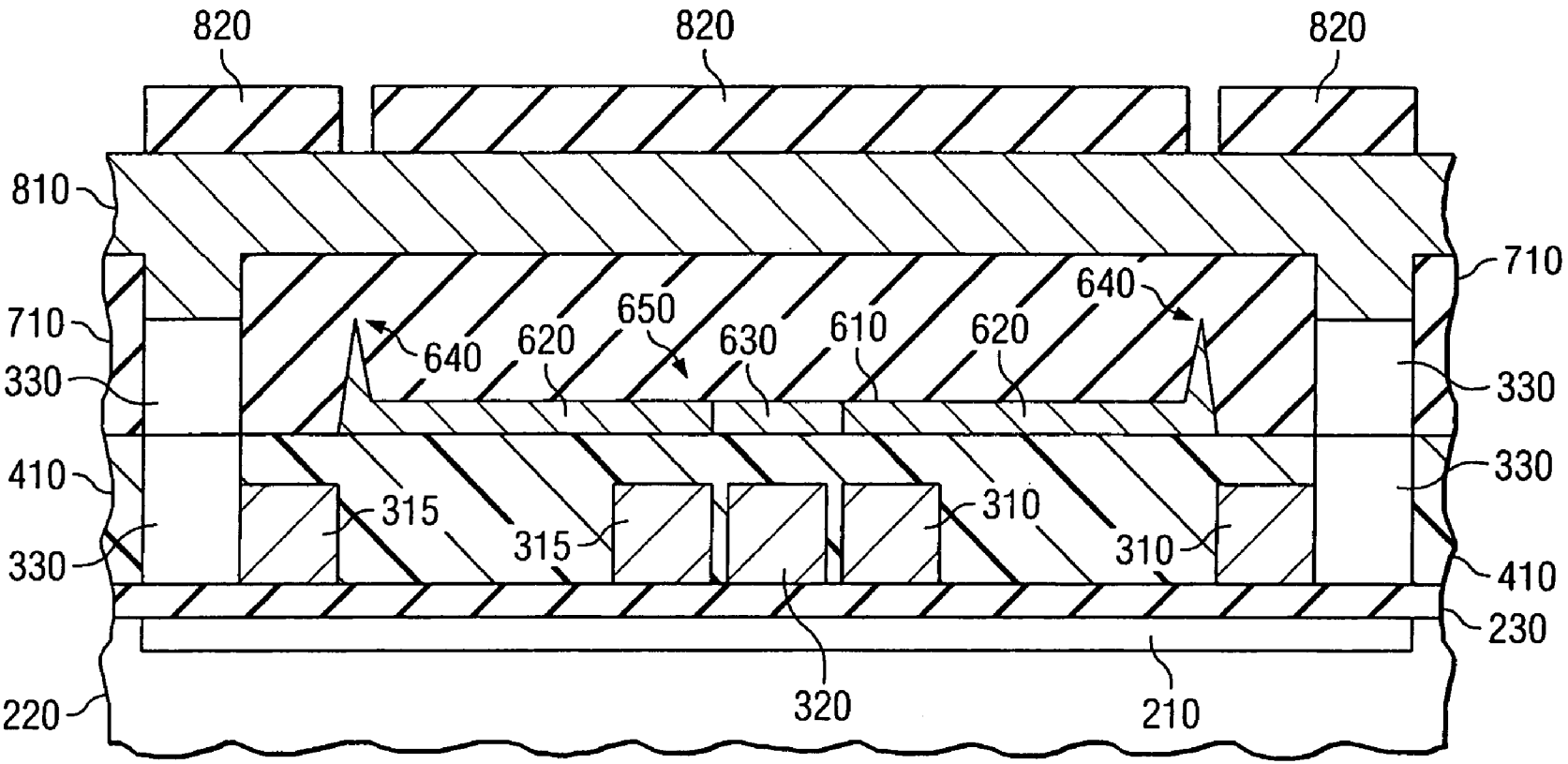

FIG. 8 depicts the partially completed field emission device 200 after forming a third metal layer 810 over the second spacer layer 710. The third metal layer 810 is formed using procedures and materials similar to those used to form the first and second metal layers 240, 510. Also illustrated is a second etch mask 820 formed over the third metal layer 810 to define a pattern for etching.

Figure 9:
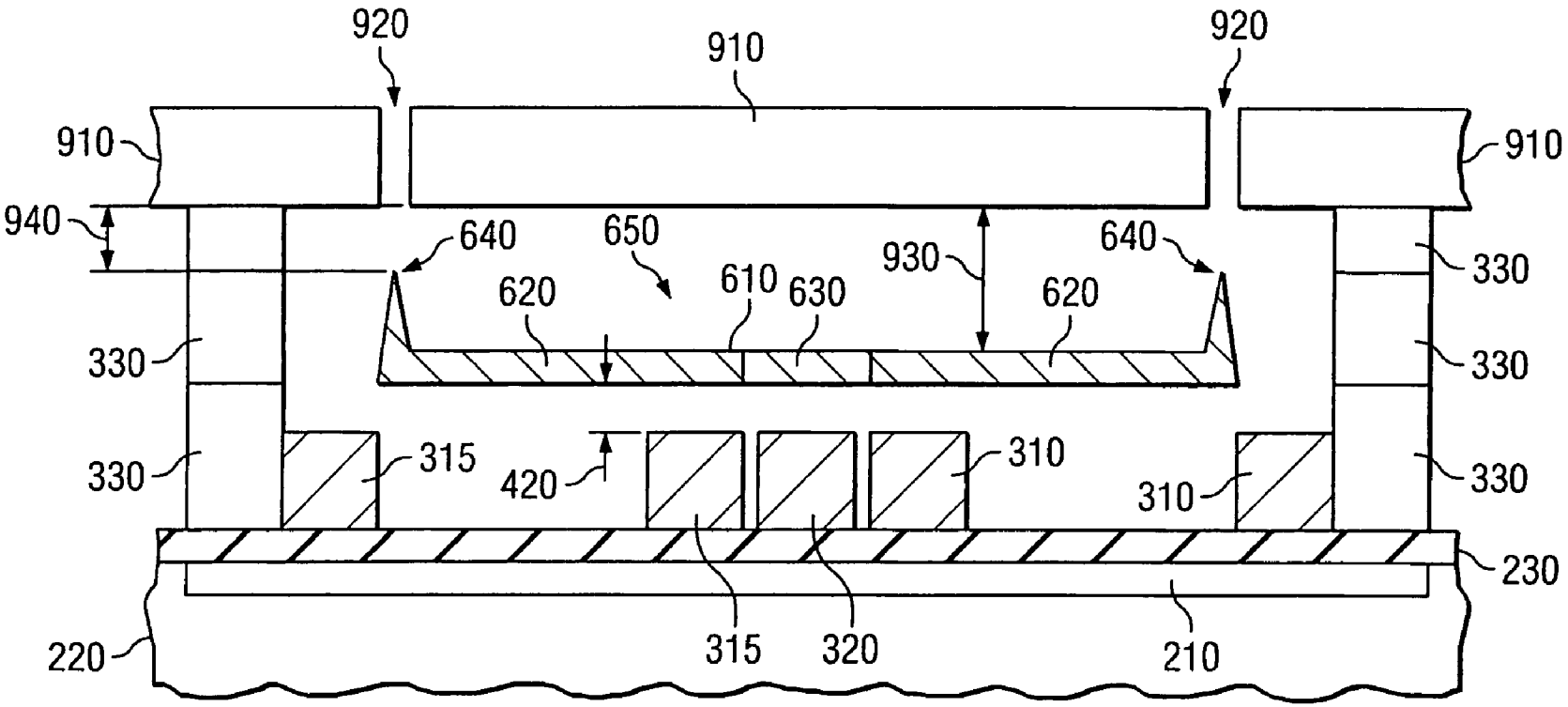

FIG. 9 illustrates the partially completed field emission device 200 after patterning the third metal layer 810 to form an anode 910 and to further form the first substrate 330. Patterning the third metal layer 810 also comprises forming one or more apertures 920 in the anode 910, preferably above the cathode tips 640. The field emission device 200 is shown after removing the first and second spacer layers 410, 710. In some embodiments, the spacer layers 410, 710 are removed using a conventional plasma-ash process. Removal of the spacer layers 410, 710 provides gaps 420 below and gaps 930 above the cathode 610 thereby facilitating the movement of the spring element 650. For the particular configuration depicted in FIG. 9, the gaps 420, 930 facilitate the movement of the spring element 650 to adjust the distance 940 separating the anode 910 and cathode 610 at the tips 640 when a voltage is applied to the cathode 610 via the control circuit 210. Of course, the method can be modified to provide a field emission device in which the anode moves to adjust the distance separating the anode and cathode 910, 610 in response to an applied voltage.

Figure 10:
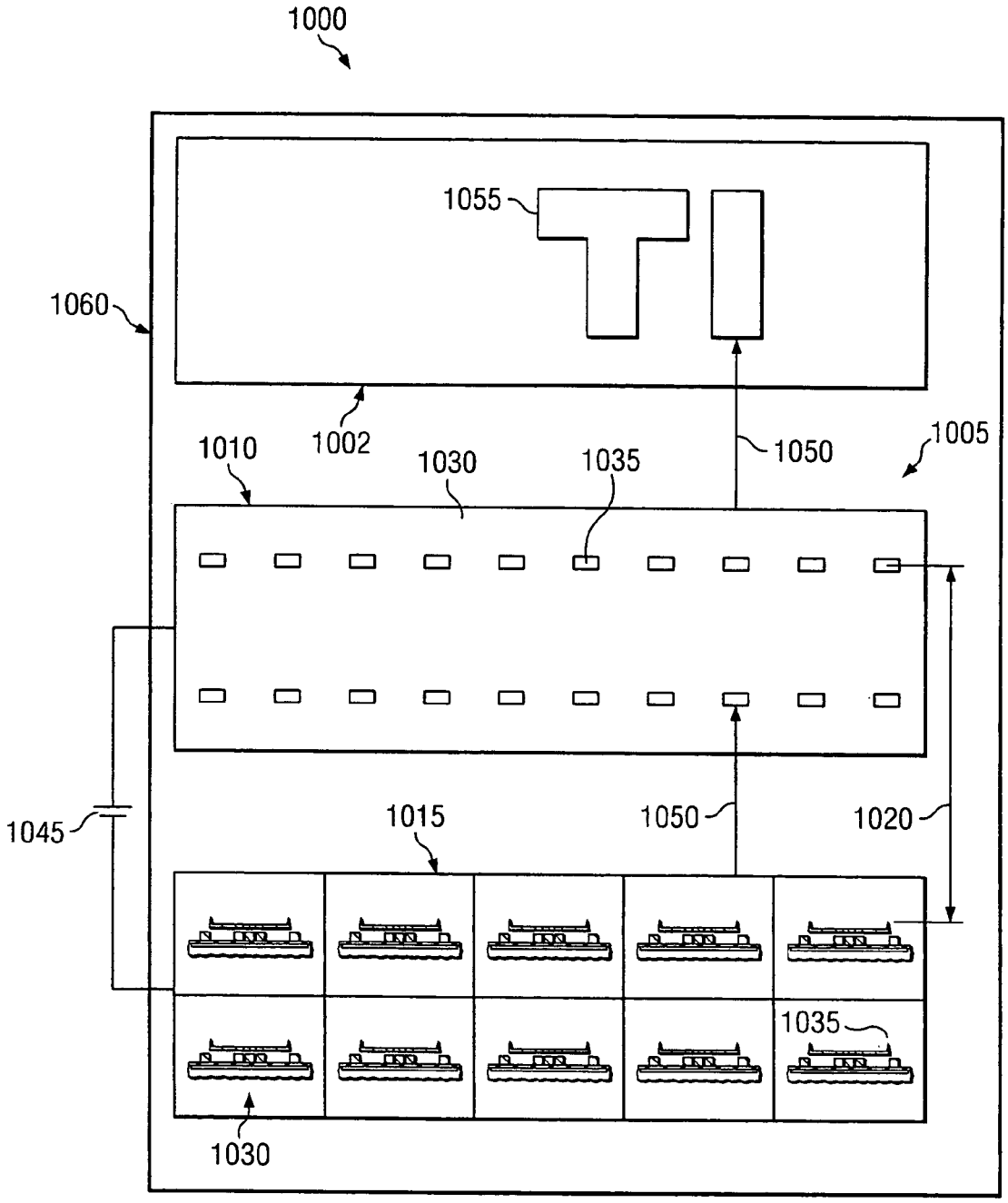
FIG. 10 illustrates an exploded schematic view of selected aspects of an example display system of the present invention.

Still another aspect of the present invention is a display system. FIG. 10 illustrates an exploded schematic view of selected aspects of an example display system 1000 following principles of the present invention. The display system 1000 comprises a phosphor surface 1002 and field emission device 1005. The phosphor surface 1002 comprises any conventional phosphorescent material used in the construction of cathode-ray tube or similar displays.

The field emission device 1005 can comprise any of the embodiments of field emission devices depicted in FIGS. 1-9 and discussed above. For instance, as illustrated in FIG. 10, the field emission device 1005 comprises an anode 1010 and a cathode 1015 separated by a distance 1020. The distance 1020 is adjusted by moving at least one of the anode 1010 or cathode 1015. At least one of the anode 1010 or cathode 1015 is configured to be movable with respect to the other in response to a voltage applied to at least one of the anode 1010 or cathode 1015.

For the particular embodiment of the system 1000 illustrated in FIG. 10, the anode 1010 comprises a metal sheet 1030 having a grid of apertures 1035 therein. The cathode 1015 comprises a plurality of cathode subunits 1030, configured in a two-dimensional array. Preferably, each cathode subunit 1030 comprises a substrate 1035 having a movable MEMS with a cathode element and a control circuit, such as discussed above in the context of FIGS. 1-9. For the system shown in FIG. 10, the cathode 1015 is configured to move to a minimal and maximal span of the distance 1020 when a first and second voltage is applied to the cathode 1015, respectively. For example, the substrate 1035 of the cathode subunit 1030 can be configured to cause movement of the cathode when a voltage is applied to components of the MEMS via the control circuit.

The system 1000 shown in FIG. 10 also comprises a voltage source 1045 that is electrically coupled to the anode 1010 and cathode 1015. When a potential is applied by the voltage source 1045, an electric field is generated between the anode 1010 and cathode 1015. The appropriate electric field, in cooperation with an adjustment of the distance 1020 to the minimal span as discussed above, causes the emission of electrons 1050 from the cathode 1015. The current of electrons 1050 passing from the cathode 1015 to the anode 1010 is configured to pass through the anode 1010 to the phosphor surface 1002 thereby causing the phosphor surface 1002 to emit light in the form of a luminescent display 1055. Of course, the distance 1020 of each cathode element 1030 of the cathode 1015 can be selectively adjusted to cause electron emission from a specific cathode element 1030, thereby illuminating a specific location on the phosphor surface 1002.

As further illustrated in FIG. 10, in some embodiments of the system 1000, one or both of the phosphor surface 1002 and field emission device 1005 are enclosed in a chamber 1060. The chamber 1060 is designed to minimize contaminating material from contacting the anode or cathode 1010, 1015 and thereby deteriorating the function lifetime of the system 1000. For instance, in some preferred embodiments, the chamber 1060 is hermetically sealed. In other embodiments, the chamber 1060 is also evacuated to further remove contaminating material present in the chamber 1060. For instance, in some cases the pressure inside the chamber 1060 is reduced below atmospheric pressure. In other embodiments of the system 1000, however, and the system 1000 is configured to operate at atmospheric pressure (e.g., about 1 atmosphere). In such embodiments, the chamber 1060 is maintained at about 1 atmosphere, or there is no chamber. An acceptable functional lifetime for the system 1000 in such instances is facilitated by configuring the cathode 1015, and more specifically cathode elements 1030, to have knife-edged tips.

Those skilled in the art to which the invention relates should appreciate that various changes, substitutions and alterations may be made to the embodiments described herein, without departing from the scope of the invention in its broadest form.

What is claimed is:

1. A field emission device, comprising:

an anode;

a cathode spaced from the anode; the cathode including a hinge portion, and a spring portion having a knife-edge tip rotatable about the hinge portion between a position of minimal spacing and a position of maximal spacing of the tip relative to the anode;

a first voltage source coupled between the anode and cathode for causing electrons to be emitted from the tip when the tip is in the minimal spacing position and to be not emitted from the tip when the tip is in the maximal spacing position; and a structure including a control circuit and electrode pads; the electrode pads being electrostatically coupled to the cathode for selectively driving the tip between the minimal and maximal spacing positions in response to a voltage applied by the control circuit.

2. The device of claim 1, wherein the anode includes an opening in alignment with the tip.

3. The device of claim 1, wherein the electrode pads include an electrode pad having an opening in alignment with the tip.

4. The device of claim 1, wherein the control circuit is a CMOS circuit.

5. The device of claim 1, wherein the spring portion is an elongated element centrally joined for rotation about the hinge portion; the knife-edge tip is a first knife-edge tip located at an end of the elongated element; and the spring portion has a second knife-edge tip located at an opposite end of the elongated element.

6. The device of claim 2, wherein the anode opening is a first opening; the electrode pads include an electrode pad having a second opening in alignment with the tip; and the tip is located between the first and second openings.

7. The device of claim 6, wherein the control circuit is a CMOS circuit.

8. The device of claim 7, wherein the spring portion is an elongated element centrally joined for rotation about the hinge portion; the knife-edge tip is a first knife-edge tip located at an end of the elongated element; the first opening is in alignment with the first knife-edge tip; the spring portion has a second knife-edge tip located at an opposite end of the elongated element; the anode includes a third opening in alignment with the second knife-edge tip; and the electrode pad includes a fourth opening in alignment with the second knife-edge tip; the second knife-edge tip being located between the third and fourth openings.

9. The device of claim 8, wherein the knife-edge of the first knife-edge tip is longer than the knife-edge of the second knife-edge tip.

10. The device of claim 5, wherein the knife-edge of the first knife-edge tip is longer than the knife-edge of the second knife-edge tip.

11. A display system, comprising:

a field emission device, including:

an anode including an opening;

a cathode spaced from the anode; the cathode including a hinge portion, and a spring portion having a knife-edge tip rotatable about the hinge portion between a position of minimal spacing and a position of maximal spacing of the tip relative to the anode;

a first voltage source coupled between the anode and cathode for causing electrons to be emitted from the tip and to pass through the opening when the tip is in the minimal spacing position and to be not emitted from the tip when the tip is in the maximal spacing position; and a structure including a control circuit and electrode pads; the electrode pads being electrostatically coupled to the cathode for selectively driving the tip between the minimal and maximal spacing positions in response to a voltage applied by the control circuit; and a phosphor surface positioned to generate light when electrons are emitted from the tip and pass through the opening.

12. The system of claim 11, wherein the anode opening is a first opening; the electrode pads include an electrode pad having a second opening in alignment with the tip; and the tip is located between the first and second openings.

13. The system of claim 11, wherein the electrode pads include an electrode pad having an opening in alignment with the tip.

14. The system of claim 11, wherein the control circuit is a CMOS circuit.

15. The system of claim 11, wherein the spring portion is an elongated element centrally joined for rotation about the hinge portion; the knife-edge tip is a first knife-edge tip located at an end of the elongated element; the first opening is in alignment with the first knife-edge tip; the spring portion has a second knife-edge tip located at an opposite end of the elongated element; the anode includes a third opening in alignment with the second knife-edge tip; and the electrode pad includes a fourth opening in alignment with the second knife-edge tip; the second knife-edge tip being located between the third and fourth openings.

16. The system of claim 12, wherein the control circuit is a CMOS circuit.

17. The system of claim 16, wherein the spring portion is an elongated element centrally joined for rotation about the hinge portion; the knife-edge tip is a first knife-edge tip located at an end of the elongated element; the first opening is in alignment with the first knife-edge tip; the spring portion has a second knife-edge tip located at an opposite end of the elongated element; the anode includes a third opening in alignment with the second knife-edge tip; and the electrode pad includes a fourth opening in alignment with the second knife-edge tip; the second knife-edge tip being located between the third and fourth openings.

18. The system of claim 17, wherein the knife-edge of the first knife-edge tip is longer than the knife-edge of the second knife-edge tip.

19. The system of claim 15, wherein the knife-edge of the first knife-edge tip is longer than the knife-edge of the second knife-edge tip.

* * * * *